United States Patent [19]

Billings et al.

[11] 4,333,322

[45] Jun. 8, 1982

[54] MOUNT FOR WASHING MACHINE

[75] Inventors: David L. Billings; Robert M. Fey; Richard A. Waugh, all of Louisville, Ky.

[73] Assignee: General Electric Company, Louisville, Ky.

[21] Appl. No.: 215,217

[22] Filed: Dec. 11, 1980

[51] Int. Cl.[3] ..... D06F 37/24

[52] U.S. Cl. ..... 68/23.2; 68/23 R; 68/23.3; 210/364; 248/568; 248/648

[58] Field of Search ..... 68/3 R, 23 R, 23.2, 68/23.3, 23.6, 23.7, 171–174; 233/1 C, 23 A; 210/364; 248/568, 636, 639, 648

[56] References Cited

U.S. PATENT DOCUMENTS

| | | | |
|---|---|---|---|
| 2,807,951 | 10/1957 | Gerhardt et al. | 68/23.7 |
| 2,854,297 | 9/1958 | Scott et al. | 308/145 |
| 2,996,908 | 8/1961 | De Zarate | 68/23 R |
| 3,021,997 | 2/1962 | Czech | 68/23.3 X |
| 3,049,025 | 8/1962 | Lannert | 68/23.3 X |
| 3,247,689 | 4/1966 | Wasemann | 68/23.7 X |
| 3,269,544 | 8/1966 | Brucken et al. | 68/23.3 X |
| 3,277,742 | 10/1966 | Jacobsen | 210/364 X |
| 3,475,928 | 11/1969 | Wasemann | 68/23.3 X |

FOREIGN PATENT DOCUMENTS

| | | | |
|---|---|---|---|
| 1053465 | 3/1959 | Fed. Rep. of Germany | 68/23.3 |

*Primary Examiner*—Philip R. Coe
*Attorney, Agent, or Firm*—Radford M. Reams

[57] ABSTRACT

An upright fabric washing machine includes a cabinet structure having a bottom frame that is formed to include a bearing for pivotally supporting an assembly of working parts of the machine. A mount includes a hollow mounting post having its lower end formed for pivotal support on the bearing and extending generally upwardly within the cabinet. A plurality of generally horizontally extending mounting arms are attached to the upper portion of the mounting post and project radially outward therefrom. A non-rotatable tub has a peripheral side wall and a bottom wall. The tub is mounted on the mount with the tub bottom wall supported by the mounting arms and with an access opening in the tub in register with the hollow mounting post. A transmission is mounted with its housing within the hollow mounting post and its output member extending upwardly within the tub. Springs connect the distal end of each of the mounting arms with the base for biasing the mount to an upright configuration. The tub includes tabs and the upper end of each of the springs extends through a corresponding tab to assist in maintaining engagement between the tub bottom and the mounting arms. The motor for the machine is supported on one of the mounting arms and is free to rotate about a first axis. A spring biases the motor to a predetermined orientation relative to that axis. An endless belt connects the motor output pulley to an input pulley of the transmission. These pulleys define an operating axis for the endless belt which is angled with respect to the axis about which the motor may pivot so that the motor pivots in order to control the torque delivered to the transmission.

13 Claims, 4 Drawing Figures

MOUNT FOR WASHING MACHINE

BACKGROUND OF THE INVENTION

It is well known in the washing machine art to provide a mounting or suspension system which moves about a fixed node in damping out undesirable movement of the operating components of the machine. A number of such mounts or suspensions have been or currently are in production by various manufacturers. None of such mounting or suspension systems is completely satisfactory. Many are constructed of a large number of components. This leads to problems both in original manufacture and in servicing. In many such systems the movable bearing member is formed separately and a number of struts are attached to that member. In such constructions all of the forces being damped are transferred through the limited number of strut-to-bearing connections.

SUMMARY OF INVENTION

It is therefore an object of the present invention to provide a new and improved mounting system for upright washing machines.

It is another object of the present invention to provide an improved mounting system of the fixed node type which is formed from a minimum number of components.

It is yet another object of the present invention to provide such an improved mounting system which is simple in construction.

It is still another object of the present invention to provide such an improved mounting system in which the forces exerted on the system are distributed rather than being concentrated at a limited number of points.

In accordance with one embodiment of the present invention there is provided an upright fabric washing machine comprising a cabinet structure having a bottom frame including a bearing for pivotally supporting an assembly of working parts of the machine. A mount includes a hollow mounting post, pivotally supported on the bearing and extending generally vertically upward within the cabinet structure, and a plurality of mounting arms, with each of the mounting arms being attached to the upper portion of the mounting post and extending outwardly in a generally horizontal direction. The machine includes a non-rotatable tube having a peripheral side wall and a bottom wall defining an access opening therethrough. The tub is secured to the mount with the tub bottom wall supported on the mounting arms and the access opening in register with the hollow mounting post. The machine also includes a transmission enclosed in a housing and having an output member extending from the upper end of the housing. The housing is secured to the mount with the housing contained substantially within the mounting post and the transmission output member extending upwardly within the non-rotatable tub.

The above-mentioned and other features and objects of this invention, as well as one manner of obtaining them, will become more apparent, and the invention itself will be more fully understood by reference to the following description, taken in conjunction with the accompanying drawings wherein:

DESCRIPTION OF THE PREFERRED EMBODIMENT

Figure 1:
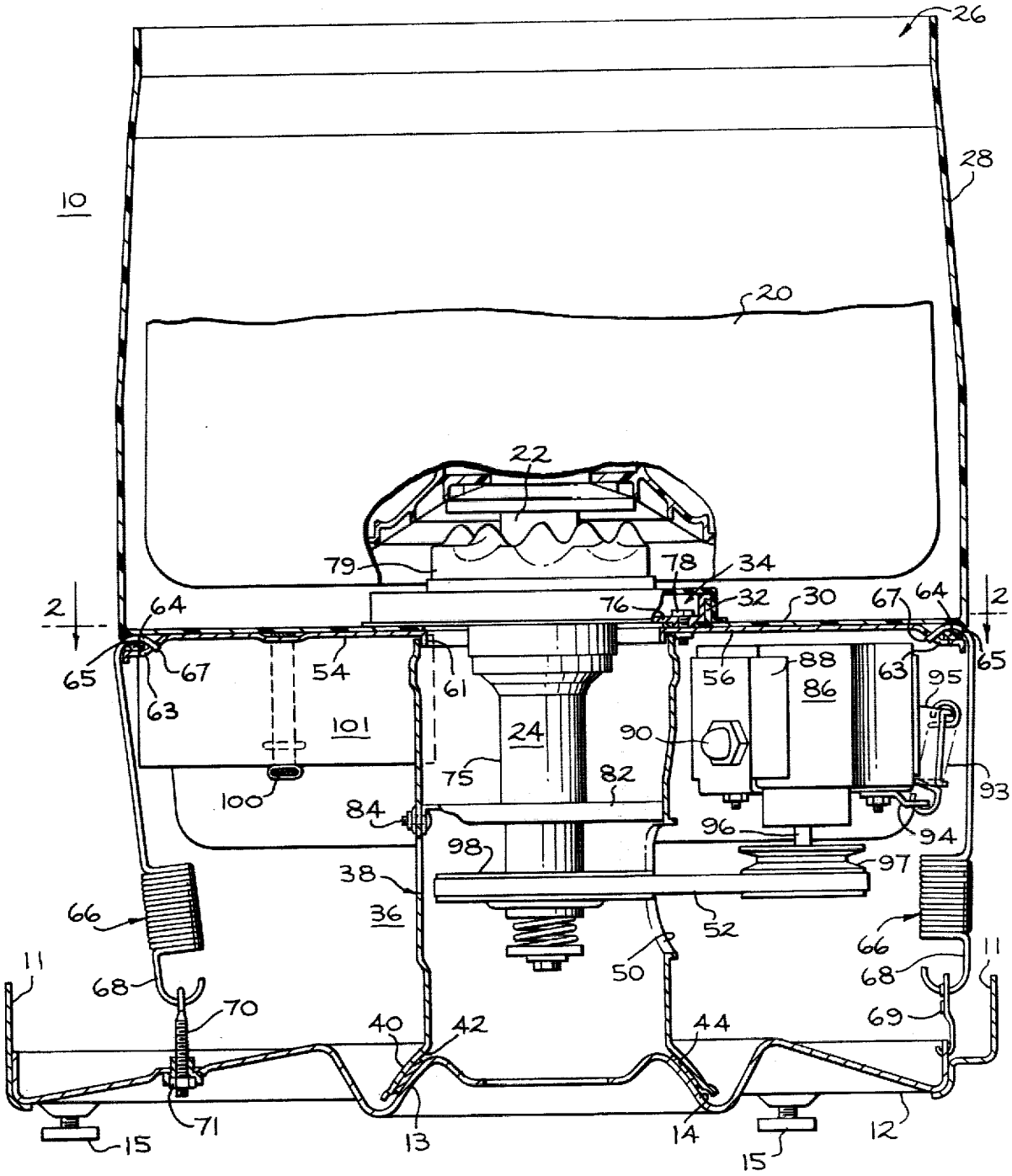
FIG. 1 is a simplified elevational view, partly broken away and partly sectioned as indicated by line 1—1 in FIG. 2, of a fabric washing machine incorporating one form of the present invention, with some parts omitted for the sake of simplicity.

Referring to the drawings, there is shown in FIG. 1 a washing machine 10 of the upright or vertical axis type which includes a cabinet having side walls 11 and a top which has been omitted for the sake of simplicity. The cabinet also includes a bottom frame 12 which is formed at its center with a portion 13 having an upper frustospherical surface 14 defining a support bearing. The frustospherical shape of bearing surface 14 results in a mount or suspension of the "fixed node" type. That is, the mechanism mounted on portion 14 will move about the center of the sphere of which bearing surface 14 is a part. A number of support feet 15 are threadedly engaged in the bottom frame 12. The height of each individual foot can be adjusted in order that the bottom frame 12 will have a level or horizontal disposition even though the support surface on which the machine is mounted may not be horizontal.

The illustrative washing machine is of the orbital type, containing a perforate basket or receptable 20 which receives fabrics to be washed. During the washing process output member 22 of a transmission 24 causes the basket 20 to orbit in a generally horizontal plane in order to wash fabrics in water and detergent received in the basket and to cause the basket 20 to rotate or spin about a central axis in order to extract liquid from the fabrics. The basket 20 is received in an imperforate, stationary or non-rotatable tub 26 having an upright peripheral side wall 28 an a generally horizontal bottom wall 30. The bottom wall 30 includes an upwardly extending flange 32 defining an access opening 34 through the center portion of the bottom wall 30. The tub 26 is received in the cabinet of the washing machine. Additional details of the construction and operation of an orbiting type washing machine may be had by reference to the copending application of John Bochan, Ser. No. 142,949, filed Apr. 23, 1980 and assigned to General Electric Company, assignee of the present invention, which application is herein incorporated by reference. It will be understood that, while the illustrative washing machine is of the orbiting type, the present invention is useful in other types of upright washing machines such as the well known agitator type washers.

An assembly of the working components of the machine are pivotally supported by a mount 36 including a hollow upright mounting post 38. The lower portion of the post 38 is generally cylindrical in cross section and its lower end is formed into a bearing portion 40 having a frustospherical bearing surface 42 which is complimentary in shape to the bearing surface 14 of the bottom frame 12. The bearing surface 42 is mounted about the bearing surface 14 with an annulus of damping type friction material 44 sandwiched therebetween. As the mounting post 36 moves about the bearing surface 14 of base 12, the friction material exercises a damping influence.

Figure 3:
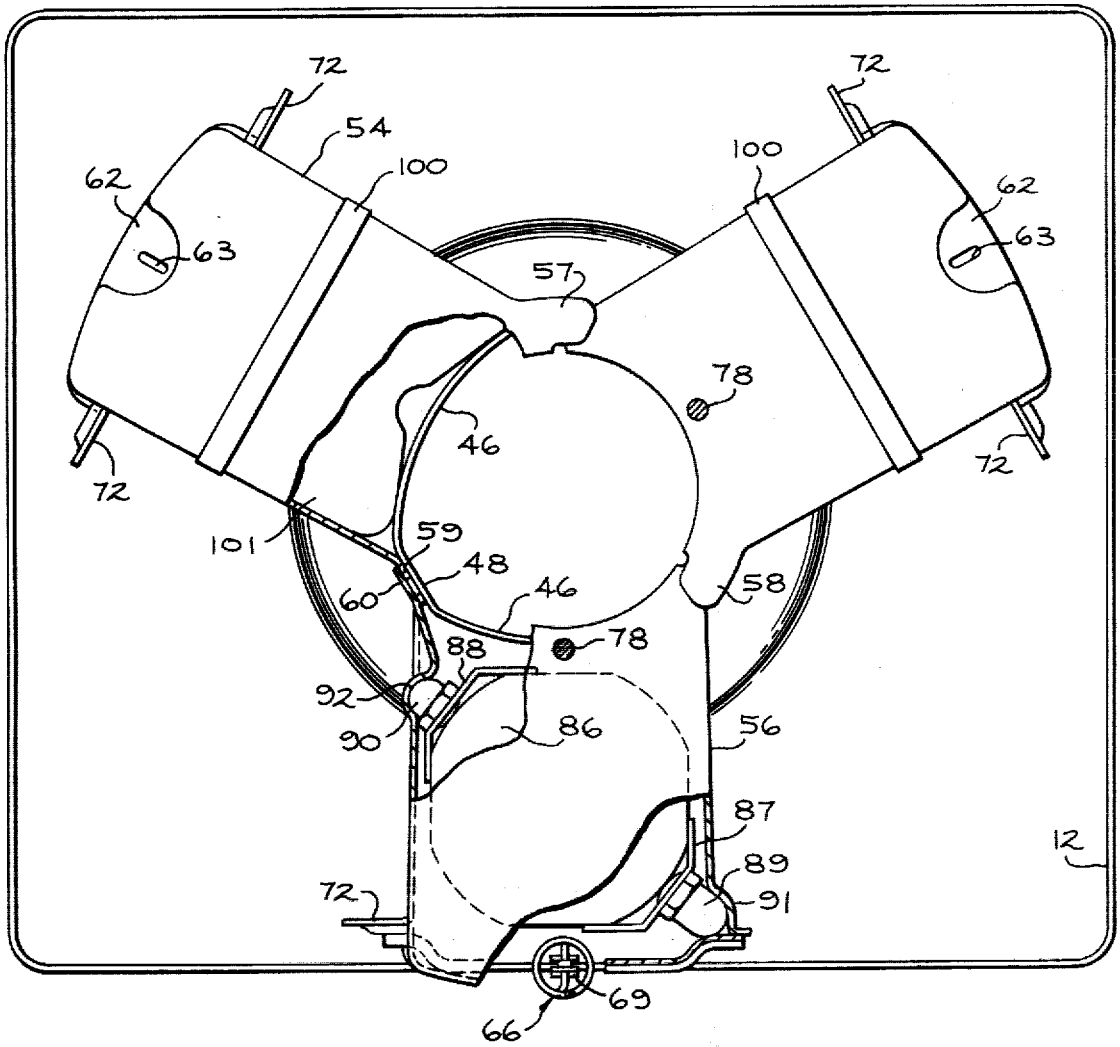
FIG. 3 is a view similar to FIG. 2 but with additional components removed for purposes of illustration.

The upper portion of the center post 36 is formed into a generally triangular cross section with three long, slightly curved portions 46 separated by short, flat portions 48 (see FIG. 3). The post 38 is provided with an opening 50 to accommodate the passage of an endless drive belt 52 between the inside and the outside of the post (see FIG. 1). Conveniently the post 38 may be formed by stamping a metal blank, rolling it into the desired form and then welding it to provide a unitary structure.

The mount 36 also includes three mounting arms 54, 55 and 56 respectively. Each of the mounting arms may be formed from a single sheet of metal folded into an elongated, hollow structure having a substantially planar upper surface (see FIG. 4). As best seen in FIG. 3 the upper surface of each of the arms is formed with a tab, two of which are shown at 57 and 58. The tab from each arm overlaps the top surface of the adjacent arm and may be welded thereto. Additionally, each side of each arm is formed with an angled extension, two of which are shown at 59 and 60. When the arms are assembled on the post, the angled extensions for an adjacent pair of arms come into overlapping relationship with each other and into register with the corresponding short, flat portion 48 of the post. The corresponding portion 48 and extensions 59 and 60 are welded together to assemble the arms to the post. As best seen in FIG. 1, the inner end of each arm is provided with a lip 61 which overhangs the top edge of the corresponding long, curved portion 46 of the post 36. Thus it can be seen that the basic mount is constructed from a minimum number of components which conveniently may begin as flat sheets of metal and be formed into the configuration desired.

The planar top surfaces of the arms 54, 55 and 56 provide a large total supporting surface for the bottom wall 30 of the tub 26. The distal end of each arm 54, 55 and 56 includes a recess 62 with an opening 63. The peripheral wall 28 of the tub includes three tabs 64 having openings 65. The tub 26 is mounted on the arms with the tabs 64 received in the recesses 62 and with the openings 63 and 65 aligned. A spring 66 attaches each of the arms 54, 55 and 56 respectively to the bottom frame 12. The upper end of each spring 66 is formed as a hook 67 which is passed through the openings 65 and 63. The lower end 68 of two of the springs are attached to the bottom frame 12 by clips, one of which is shown at 69 in FIG. 1. The lower end 68 of the other spring 66 is attached to the bottom frame 12 by means of an eye bolt 70 and nut 71. The springs 66 bias the mount so that the center post 38 tends to center itself on the frustospherical bearing surface 14 and extends therefrom in a generally vertical direction. The eye bolt 70 and nut 71 are used during assembly to compensate for manufacturing tolerances and properly align the mount.

Figure 2:
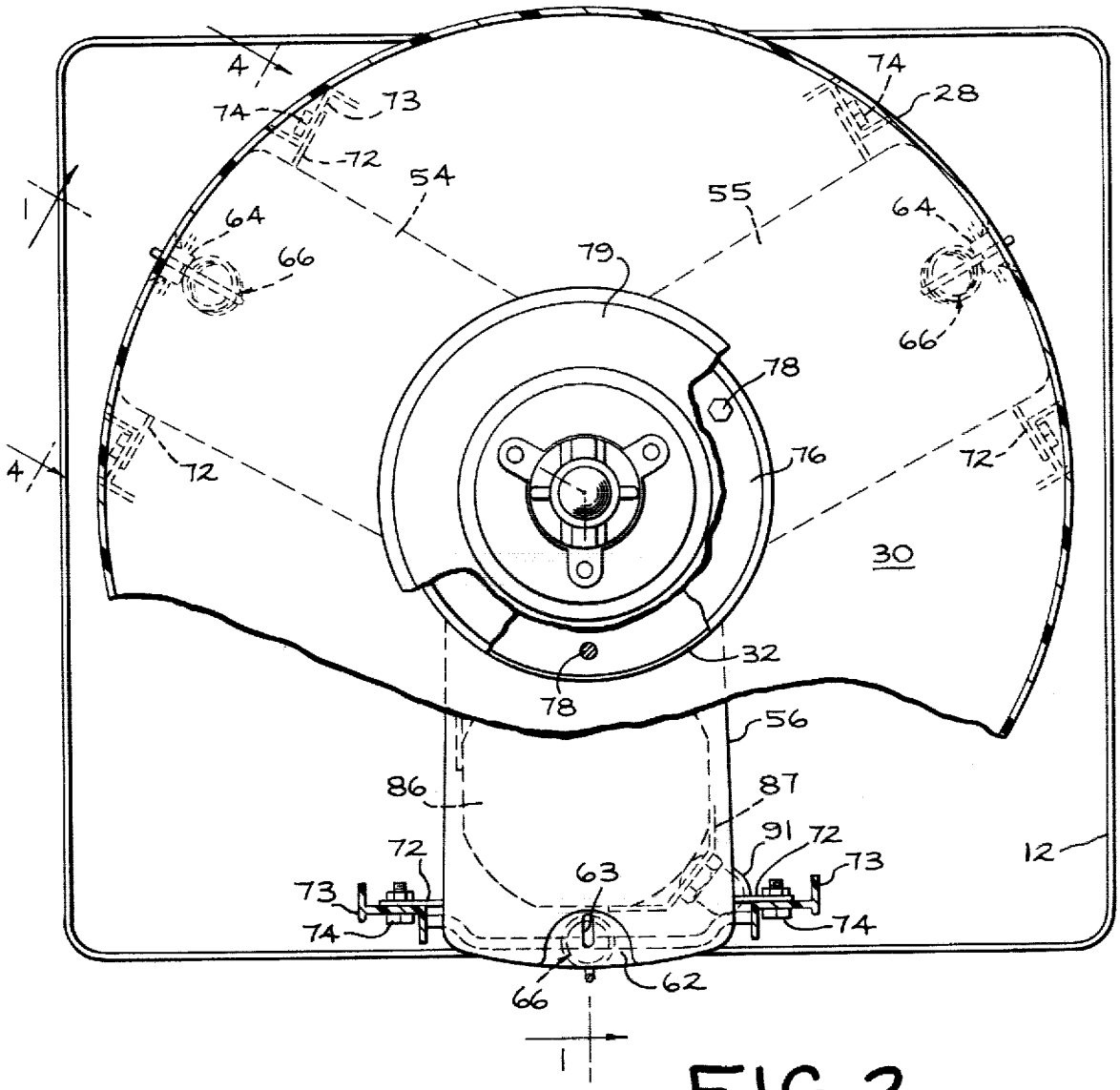
FIG. 2 is a somewhat simplified cross-sectional view taken along line 2—2 of FIG. 1, partly broken away and with some components omitted for the sake of simplicity.
Figure 4:
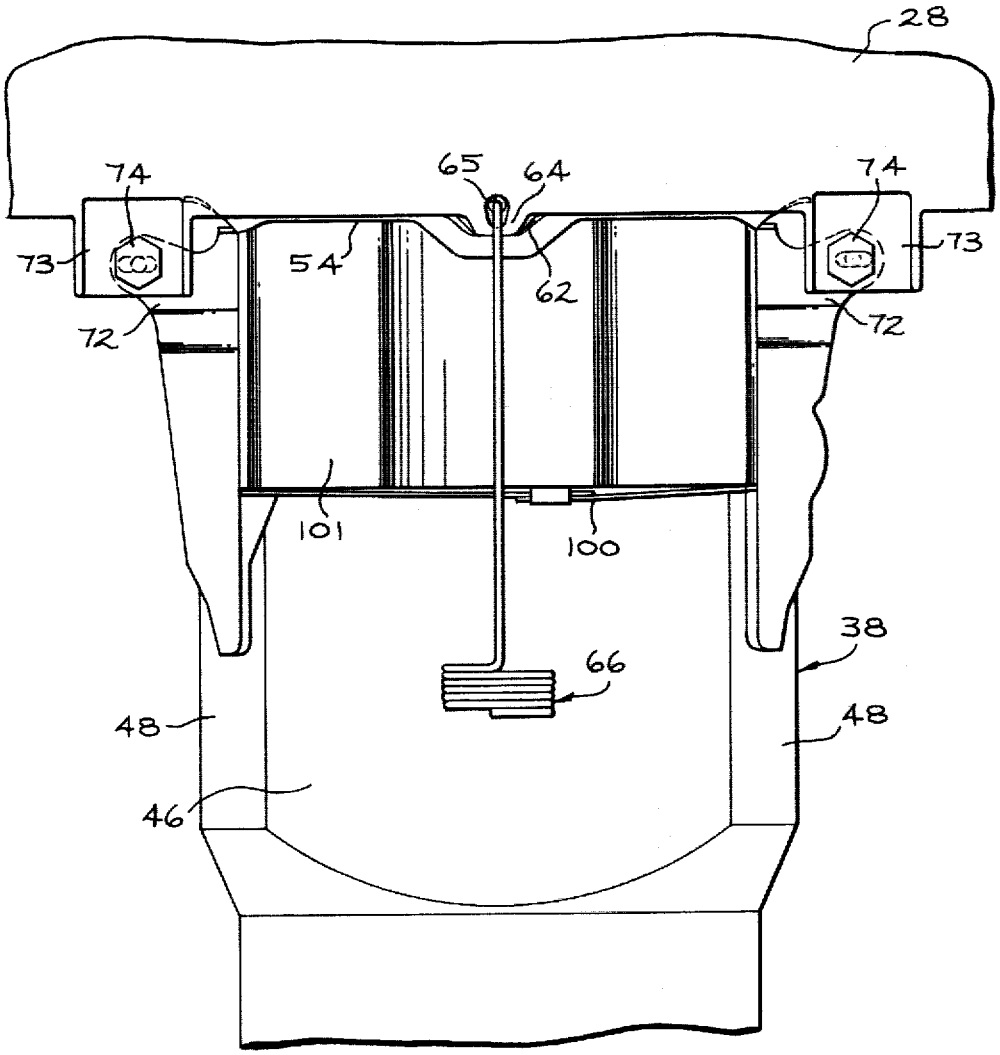
FIG. 4 is a somewhat simplified fragmentary elevational view as seen along line 4—4 of FIG. 2.

The distal end of each side wall of each arm 54, 55 and 56 is bent outwardly of the main portion of that side wall as a flange 72. As best seen in FIGS. 2 and 4, the tub peripheral wall 28 is formed with depending ears 73, corresponding in number and position to the flanges 72. The flanges 72 and ears 73 are provided with slots which come into register when the tub is mounted to the arms. Nut and bolt arrangements 74 connect the ears to the flanges to assist in holding the bottom wall of the tub against the top surface of the arms.

Referring now to FIG. 1. It will be seen that, when the tub 26 is assembled to the arms the opening 34 formed in the central portion of the tub by flange 32 is in register with the hollow mounting post 38. The transmission 24 includes a housing 75 having a flange 76 at its upper end through which drive member 22 extends. The transmission is mounted in a generally vertical orientation within the hollow mounting post 38 with the flange 76 overlying the inner edge of the mounting arms 54, 55 and 56 and overlying the inner edge of the tub flange 32. Bolts 78 clamp the transmission flange 76 to the mount. Thus the upper end of the transmission is supported by the mount and the inner edge of the tub flange 32 is firmly attached to the mount. A boot 79 is mounted about the upstanding portion of the flange 32 and rides against the transmission output member 22 to provide a seal preventing liquid within the tub 26 from reaching the transmission or other operating parts of the machine.

A mounting flange 82 is secured to the lower portion of the transmission housing 75. For example, the outer surface of the housing 75 may be stepped and the flange 82 placed around the smaller diameter lower portion of the housing with a tight fit and seated against the stepped portion of the housing. The flange 82 is provided with a number of slots open to the bottom and the mounting post 38 is provided with a corresponding number of openings. Carriage bolt arrangements 84 are loosely threaded in the openings in mounting post 38. Then the transmission housing, including flange 82, is slid downwardly within the post 38 and the slots in the flange 82 are fit around the carriage bolts. Then, after the top of the transmission is secured by bolts 78, the carriage bolt arrangements 84 are tightened to provide firm support for the lower end of the transmission.

Referring now particularly to FIGS. 1 and 3, it will be seen that the drive motor 86 includes a pair of brackets 87 and 88 positioned at diagonally opposite corners of the motor. Self-lubricating bearings 89 and 90 are carried by the brackets 87 and 88 respectively. Diagonally opposite side wall portions of mounting arm 56 are formed with cupped recesses 91 and 92 respectively. The bearing 89 is rotatably received in the recess 91 and the bearing 90 is received in the recess 92. The bearings 89 and 90 define an axis about which the motor 86 may pivot. As best seen in FIG. 1 a spring 93 is connected at one end by a bracket 94 to the motor 86, and at the other end, by a bracket 95 to the arm 56. The spring 93 biases the motor 86 to a predetermined position relative to the axis defined by the bearings 89 and 90.

A motor output or drive shaft 96 extends downwardly from the lower end of the motor and is provided with a double drive pulley 97. A transmission input pulley 98 extends from the lower end of the transmission housing 24 in alignment with the pulley 97. The endless belt 52 connects the motor output pulley 97 with the transmission input pulley 98 so that rotation of the motor output shaft in a predetermined direction causes the transmission 24 either to oscillate the basket 20 or to rotate the basket 20 to provide the desired action. The pulleys 97 and 98 define a second axis about which the endless belt 52 operates. This second axis is angled with respect to the first axis defined by the bearings 89 and 90. Thus the motor 86 will pivot about the first axis in order to control the torque delivered by the motor to the transmission.

It will be understood that other torque limiting arrangements may be employed. For example, the motor can be firmly mounted on arm 56. A torque limiting clutch would be connected to the motor output shaft and the belt 52 would connect the clutch output to the transmission. The use of such torque limiting clutch arrangements are well known in the washing machine art.

The other portion of the motor output pulley 97 may be used with an additional belt in order to drive a conventional fluid pump for pumping water from the tub 26. That arrangement has been omitted for the sake of simplicity.

The other two mounting arms 54 and 55 are identical to each other and are basically similar to arm 56 except that, for example, they do not have cupped recesses such as 91 and 92. Straps 100 hold weights, such as concrete blocks 101 within each of the arms 54 and 55. The concrete blocks are sized and positioned in accordance with the weight of the motor 86 and other operating components of the machine so that the weight placed on the mount 36 is distributed substantially equally around the mount. It will be understood that, while three mounting arms and two weights have been shown in the illustrative machine, other numbers of mounting arms, for instance four, and other numbers of counterweights may be utilized so long as the weight placed on the mount is distributed substantially equally.

During operation the orbiting of the basket and the rotation of the basket tend to cause the mount to vibrate and oscillate about the frustospherical surface 14. The friction material 44 absorbs some of this energy and tends to damp out such vibrations or oscillations. Additionally the springs 66 tend to oppose such forces and maintain the mount in a generally vertical configuration. The construction of the mount itself including the hollow mounting post 38 and the mounting arms 54, 55 and 56 form a simple but rugged assembly which provides excellent support for the tub and transmission, as well as other operating components of the machine such as the motor 86. Additionally the construction of the mount spreads the moment of the forces acting on the mount and alleviates problems of concentrated force.

While in accordance with the patent statutes we have described what at present is considered to be the preferred embodiment of this invention, it will be obvious to those skilled in the art that various changes and modifications may be made therein without departing from the invention. It is applicants' intention in the following claims to cover all such equivalent variations as follows in the true spirit and scope of the invention.

What is claimed is:

1. An upright fabric washing machine comprising:

a cabinet structure having a bottom frame including a bearing for pivotally supporting an assembly of working parts of said machine;

a mount including a hollow mounting post pivotally supported on said bearing and extending generally vertically upward within said cabinet structure and a plurality of mounting arms, each of said mounting arms being attached to the upper portion of said mounting post and extending outwardly in a generally horizontal direction;

a non-rotatable tub having a peripheral side wall and a bottom wall defining an access opening therethrough;

means securing said tub to said mount with said tub bottom wall supported by said mounting arms and with the access opening in register with said hollow mounting post;

a transmission enclosed in a housing and having an output member extending from an upper end of said housing; and means securing said housing to said mount with said housing disposed substantially within said mounting post and said output member extending upwardly within said tub.

2. A fabric washing machine as set forth in claim 1 wherein a portion of said bottom frame is formed in a frustospherical shape to provide said bearing and the lower end of said mounting post is formed with a frustospherical shape complimentary to the shape of said bearing; said lower end of said mounting post being slidably mounted about said bearing with a body of friction material sandwiched therebetween.

3. A fabric washing machine as set forth in claim 1 further including a motor for powering said transmission and at least one counterweight; said at least one counterweight being so sized relative to the operating components including said motor and said at least one counterweight being mounted to said mounting arms in a configuration such that the weight is distributed substantially evenly about said mount.

4. A fabric washing machine as set forth in claim 1 wherein:

there are three mounting arms spaced equally about and extending radially outward of said mounting post; said machine further includes a motor for powering said transmission, and means for supporting said motor on a first one of said mounting arms; and said machine further includes first and second counterweights, and means for attaching each of said counterweights to a corresponding other one of said mounting arms so that the weight is distributed substantially evenly about said mount.

5. A fabric washing machine as set forth in claim 1 wherein:

said machine further comprises a motor for powering said transmission means, said motor including a motor output pulley;

means supporting said motor on a corresponding one of said mounting arms, said means being constructed and arranged to permit said motor to pivot about a first axis;

resilient means interconnecting said motor and said corresponding mounting arm and biasing said motor to a predetermined position relative to said first axis;

said transmission further comprises an input pulley; and an endless belt drivingly interconnects said motor output pulley and said input pulley;

said output and input pulleys define an axis of operation of said belt angled with respect to said first axis whereby said motor pivots about said first axis against the bias of said resilient means to control the torque transmitted to said input pulley.

6. A fabric washing machine as set forth in claim 1, further comprising a plurality of springs, each spring connecting a corresponding one of said mounting arms and said cabinet bottom frame to bias said mount toward a generally vertical attitude.

7. A fabric washing machine as set forth in claim 6 wherein:

said tub includes a plurality of tabs and each spring engages a corresponding tab to help maintain engagement between said tub and said mounting arms.

8. A fabric washing machine as set forth in claim 7 further including means attaching said tub to the distal end of each of said mounting arms to help maintain engagement between said tub and said mounting arms.

9. A fabric washing machine as set forth in claim 1 wherein each of said mounting arms is formed by a sheet of metal folded into an elongated, hollow structure having a substantially planar upper surface extending in supporting relationship to said tub bottom, an inner end attached to said mounting post and a radially outward distal end.

10. A fabric washing machine as set forth in claim 9, further comprising a plurality of springs, each spring connecting said distal end of a corresponding one of said mounting arms and said cabinet bottom frame to bias said mount toward a generally vertical attitude.

11. A fabric washing machine as set forth in claim 10 wherein: said tub includes a plurality of tabs and each spring engages a corresponding tab to help maintain engagement between said tub and said mounting arms.

12. A fabric washing machine as set forth in claim 9 wherein:

there are three mounting arms spaced equally about and extending radially outward of said mounting post; said machine further includes a motor for powering said transmission, means for supporting said motor on a first one of said mounting arms; said machine further includes first and second counterweights, and means for attaching each of said counterweights to a corresponding other one of said mounting arms so that the weight is distributed substantially about said mount.

13. A fabric washing machine as set forth in claim 12 wherein:

said means for supporting said motor on said first of said mounting arms is constructed and arranged to permit said motor to pivot about a first axis;

resilient means interconnects said motor and said first mounting arm and biases said motor to a predetermined position relative to said first axis;

said motor includes an output pulley and said transmission includes an input pulley;

an endless belt drivingly interconnects said output and input pulleys; and said output and input pulleys define an axis of operation of said belt angled relative to said first axis whereby said motor pivots about said first axis against the bias of said resillient means to control the torque transmitted to said input pulley.

* * * * *